US011772104B2

(12) United States Patent
Wilder et al.

(10) Patent No.: US 11,772,104 B2
(45) Date of Patent: Oct. 3, 2023

(54) DECANTER CENTRIFUGE NOZZLE

(71) Applicant: National Oilwell Varco, L.P., Houston, TX (US)

(72) Inventors: Floyd Wilder, Magnolia, TX (US); Neil Mackley, Edmonton (CA); Carlos Garza Gutierrez, The Woodlands, TX (US); Nicholas Kasunic, Butler, PA (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 331 days.

(21) Appl. No.: 16/908,341

(22) Filed: Jun. 22, 2020

(65) Prior Publication Data

US 2021/0394203 A1 Dec. 23, 2021

(51) Int. Cl.
*B04B 1/20* (2006.01)

(52) U.S. Cl.
CPC ..... *B04B 1/20* (2013.01); *B04B 1/2008* (2013.01)

(58) Field of Classification Search
CPC ..... B04B 1/20; B04B 2001/2033; B04B 2001/2066; B04B 11/06; B04B 1/2008
USPC ..... 494/53, 60
See application file for complete search history.

(56) References Cited

U.S. PATENT DOCUMENTS 3,228,592 A * 1/1966 Shapiro ..... B04B 11/02 494/53
3,398,888 A * 8/1968 Koenecke ..... B04B 7/04 494/60
3,368,747 A 12/1968 Lavanchy et al.
3,568,919 A * 3/1971 Nielsen ..... B04B 1/20 494/53
3,620,442 A * 11/1971 Halloran, Jr. ..... B04B 1/20 494/53
4,323,190 A * 4/1982 Bessette ..... B04B 1/20 494/60

(Continued)

FOREIGN PATENT DOCUMENTS

CN 202823651 U 3/2013
CN 103447167 A 12/2013

(Continued)

OTHER PUBLICATIONS

European Search Report dated Nov. 18, 2021, issued by the European Patent Office in related European Patent Application No. EP-21180834.0 (10 pages).

*Primary Examiner* — Charles Cooley
(74) *Attorney, Agent, or Firm* — Nolte Lackenbach Siegel

(57) ABSTRACT

A decanter centrifuge includes one or more nozzles through which a slurry may be discharged from a feed chamber into a separation zone within a centrifuge bowl. A scroll conveyor may be coaxially aligned in the separation zone within the centrifuge bowl around the circumference of the feed chamber. In the separation zone, the slurry can be separated into at least a light phase and a heavy phase by centrifugal acceleration generated by rotation of the centrifuge bowl, the feed chamber, and/or the scroll conveyor. Each separated phase can discharge from the centrifuge bowl via respective discharge ports. Each nozzle may include a rectangular aperture and differentiated profiles of its leading edge and trailing edge. In some embodiments, the leading edge of the aperture comprises a rounded profile, while the trailing edge comprises an abrupt edge or a less-rounded edge.

20 Claims, 7 Drawing Sheets

(56) References Cited

U.S. PATENT DOCUMENTS

| | | | | | |
|---|---|---|---|---|---|
| 5,380,434 | A * | 1/1995 | Paschedag | B01D 33/11 | 210/360.2 |
| 5,971,907 | A * | 10/1999 | Johannemann | B04B 1/20 | 494/37 |
| 6,024,686 | A * | 2/2000 | Madsen | B04B 1/20 | 494/54 |
| 6,605,029 | B1 * | 8/2003 | Koch | B04B 1/20 | 494/53 |
| 6,780,147 | B2 * | 8/2004 | Koch | B04B 1/20 | 494/53 |
| 6,790,169 | B2 * | 9/2004 | Koch | B04B 11/06 | 494/53 |
| 7,247,133 | B2 * | 7/2007 | Gronnegaard | B04B 1/20 | 494/53 |
| 7,374,529 | B2 * | 5/2008 | Hensley | B04B 1/20 | 494/53 |
| 9,333,515 | B2 * | 5/2016 | Reiff | B04B 1/20 | |
| 9,393,574 | B1 * | 7/2016 | Morris | B04B 1/20 | |
| 9,931,643 | B2 * | 4/2018 | Huyghe | B04B 1/20 | |
| 2006/0240966 | A1 | 10/2006 | Lantz | | |
| 2023/0149950 | A1 * | 5/2023 | Maxwell | B04B 11/06 | 210/787 |

FOREIGN PATENT DOCUMENTS

| | | | |
|---|---|---|---|
| KR | 10-2512923 | B1 * | 3/2023 |
| WO | 03076078 | | 9/2003 |
| WO | 2012089824 | A1 | 7/2012 |

* cited by examiner

DECANTER CENTRIFUGE NOZZLE

BACKGROUND

Decanter centrifuges rely on centrifugal acceleration to continuously separate solid materials from liquids in a slurry. Decanter centrifuges can enhance the settling rate (and therefore improve separation) by keeping solids at increased centrifugal forces for longer durations. Settling rate in a decanter centrifuge may be a function of retention time, spinning speed, pool depth, and differential density. By accelerating the fluid more rapidly, solids may settle out faster.

A typical decanter centrifuge includes a rotating centrifuge bowl, a conical beach at a tapered end of the bowl, a nozzle where a slurry is discharged into the bowl from an internal feed chamber, a screw conveyor to convey separated solids to a solids discharge, and a liquids discharge. In a typical decanter centrifuge, the solids form a bowl wall cake along inside surfaces of the centrifuge bowl. As slurry is accelerated and discharged into the bowl, it can strike the wall cake, which may unevenly disturb the wall cake and result in unbalanced weight distribution within the bowl. A non-homogeneous wall cake could lead to undesirable vibration of the decanter centrifuge, thereby reducing performance and/or increasing wear on the machinery.

BRIEF DESCRIPTION OF THE DRAWINGS

The present disclosure is best understood from the following detailed description when read with the accompanying figures.

in FIG. 4.

Figure 1:
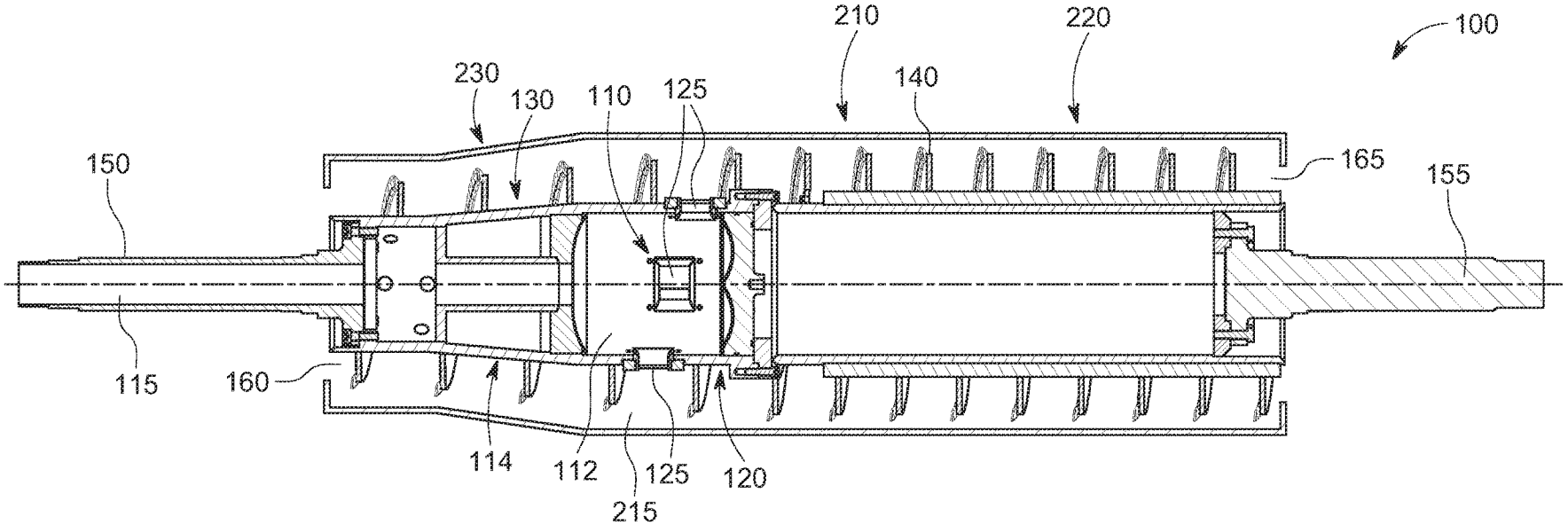
FIG. 1 is a lateral, sectioned view of selected elements of a decanter centrifuge according to one or more embodiments of the disclosure.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, reference is made to exemplary embodiments in which the disclosure may be practiced. These embodiments are described in sufficient detail to enable those skilled in the art to practice the concepts disclosed herein, and it is to be understood that modifications to the various disclosed embodiments may be made, and other embodiments may be utilized, without departing from the spirit and scope of the present disclosure. The following detailed description is, therefore, not to be taken in a limiting sense.

Reference throughout this specification to "one embodiment," "an embodiment," "one example," or "an example" means that a particular feature, structure, or characteristic described in connection with the embodiment or example is included in at least one embodiment of the present disclosure. Thus, appearances of the phrases "in one embodiment," "in an embodiment," "one example," or "an example" in various places throughout this specification are not necessarily all referring to the same embodiment or example. Furthermore, the particular features, structures, or characteristics may be combined in any suitable combinations and/or sub-combinations in one or more embodiments or examples.

Embodiments of the present disclosure include a decanter centrifuge having one or more nozzles adapted to discharge a slurry from a centrifuge feed chamber into a separation zone within a centrifuge bowl. According to various embodiments, such discharge may have a shorter spiral through the separation zone compared to that of traditional discharge nozzles, which may lead to reduced disturbance of bowl wall cake. As a result, embodiments of the present disclosure may lead to reduced bowl wear, reduced vibration of the centrifuge, and improved solid cut point. According to various embodiments, tangential discharge of slurry from the nozzles into the centrifuge bowl may be associated with higher slurry exit velocity.

Referring to FIG. 1, one embodiment of the present disclosure comprises a decanter centrifuge 100. Embodiments of decanter centrifuge 100 comprise a feed chamber 110, within the interior of a centrifuge bowl 210, rotatably mounted to a base frame and housing (not shown) on one or more trunnions 150, 155.

In various embodiments, feed chamber 110 and centrifuge bowl 210 are adapted to rotate independently from each other within the base frame and the housing, such that feed chamber 110 and centrifuge bowl 210 may be driven at respectively different rotational speeds. In some embodiments, feed chamber 110 rotates at greater speeds than that of centrifuge bowl 210. In other embodiments, feed chamber 110 rotates at lesser speeds than that of centrifuge bowl 210.

In some embodiments, centrifuge bowl 210 is rotationally fixed to a base frame and/or centrifuge housing, such that it remains stationary while feed chamber 110 may rotate within the centrifuge bowl 210. In one embodiment, feed chamber 110 and centrifuge bowl 210 are rotationally fixed to each other and rotate at the same time and at the same speed.

Feed chamber 110 defines an interior volume 112 formed by outer annular walls. 114 Embodiments of feed chamber 110 comprise a cylindrical section 120 and a frustoconical section 130, the cylindrical section 120 and frustoconical section 130 being defined by respective sections of outer annular wall 114 of the feed chamber 110. A slurry (not shown) to be separated may be fed to feed chamber 110 via feed tube 115. The slurry may then be discharged into the separation zone 215 of centrifuge bowl 210 via nozzles 125.

One or more nozzles 125 placed on cylindrical section 120 provide fluid communication from the interior volume 112 of feed chamber 110 to the annular volume between feed chamber 110 and centrifuge bowl 210.

Embodiments of decanter centrifuge 100 comprise a scroll conveyor 140 coaxially aligned within centrifuge bowl 210 around the circumference of feed chamber 110. In one embodiment, scroll conveyor 140 flights are fixed to the exterior walls 114 of feed chamber 110 and thus rotate in synchronization with feed chamber 110. In another embodiment, scroll conveyor 140 is adapted to rotate independently from feed chamber 110.

According to embodiments, feed chamber 110 is supported on, and rotated by, feed trunnion 150 and gear trunnion 155. Feed trunnion 150 houses a portion of feed tube 115. In the embodiment depicted, gear trunnion 155 applies rotational force to rotate the feed chamber 110 relative to centrifuge bowl 210 in the direction indicated in FIG. 2 by arrow 157.

In various embodiments, a drive motor (not shown) is adapted to apply rotation to rotating elements of decanter centrifuge 100. In embodiments, the drive motor drives the rotation directly. In other embodiments, drive motor applies rotation via a drive belt, drive gears, a drive pully, via other mechanisms, or combinations thereof.

Embodiments of centrifuge bowl 210 comprise a cylindrical section 220 and a frustoconical section 230, which respectively encircle cylindrical section 120 and frustoconical section 130 of feed chamber 110. The inner inclined surfaces of the frustoconical section 230 may be known in the art as the "beach" of centrifuge bowl 210.

According to embodiments, centrifuge bowl 210 is adapted to rotate in a clockwise direction (looking at centrifuge bowl 210 along its axis from its end opposite frustoconical section 230). As stated above, scroll conveyor 140 can rotate, relative to centrifuge bowl 210, in a direction indicated by arrow 157. Arrow 157 indicates a counterclockwise direction (looking at feed chamber 110 along its axis from its end opposite frustoconical section 130). As a first example, this means that scroll conveyor 140 may be rotating in the same absolute direction as, but at a slower absolute rotational speed than, centrifuge bowl 210. As a second example, this also means that scroll conveyor 140 may be rotating in an absolute direction opposite to the rotational direction of centrifuge bowl 210. In the first example, the rotational speed of scroll conveyor 140 relative to centrifuge bowl 210 is slower than that of the second example.

As would be understood by a person of ordinary skill in the art having the benefit of this disclosure, a higher rotational speed difference between scroll conveyor 140 and centrifuge bowl 210 may result in a shorter stay time for solids within centrifuge bowl 210. In contrast, a lower rotational speed difference between scroll conveyor 140 and centrifuge bowl 210 may result in a longer stay time for solids within centrifuge bowl 210.

Figure 2:
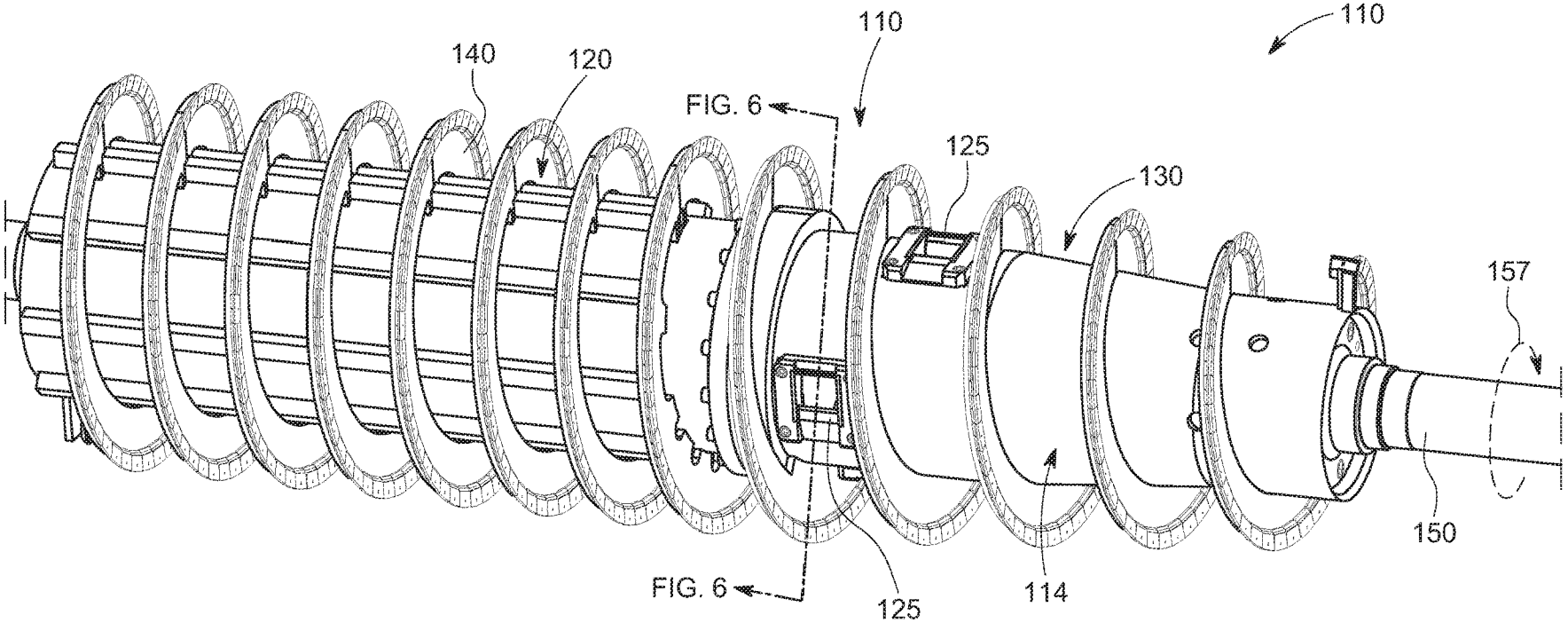
FIG. 2 depicts a feed chamber in a perspective view in the embodiment of FIG. 1.
Figure 3:
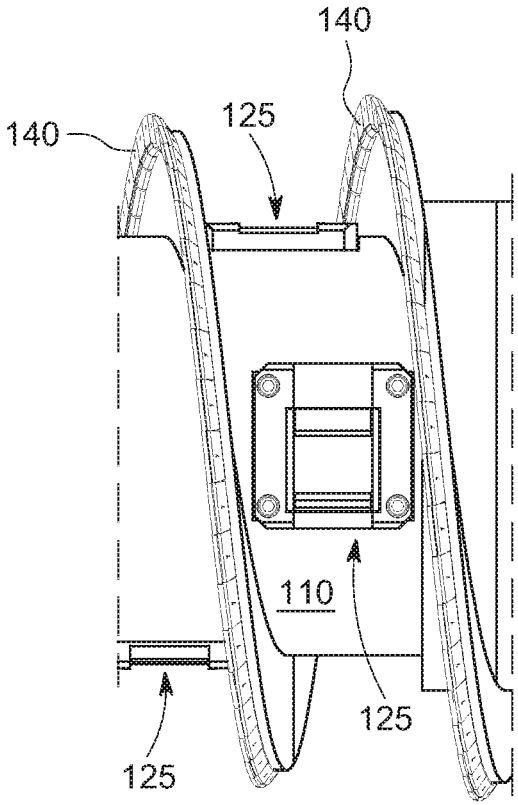
FIG. 3 is a detailed, plan view of a nozzle first shown in FIG. 2 positioned between scroll conveyor flights of the embodiment of FIG. 1.

Referring to FIG. 2, embodiments of decanter centrifuge 100 comprise multiple nozzles 125 around cylindrical section 120 of feed chamber 110. As depicted in FIG. 2, the orientation of decanter centrifuge 100 is horizontally flipped relative to its depiction in FIG. 1. As shown by FIGS. 2 and 3, nozzles 125 are positioned between flights of scroll conveyor 140 around exterior annular wall 114 of feed chamber 110, so that slurry may pass through nozzles 125 without impacting the flights of scroll conveyor 140.

In various embodiments of the present disclosure, multiple nozzles 125 may be thus positioned, the arrangement thereof forming a helical pattern around and along the feed chamber 110 exterior wall 114. In one embodiment, each nozzle 125 is positioned approximately ninety degrees apart from each other along the feed chamber 110 exterior wall 114. In other embodiments, nozzles 125 are positioned closer together to each other. In other embodiments, nozzles 125 are positioned farther from each other. In some embodiments of the present disclosure, nozzles 125 are also placed around frustoconical section 130 of feed chamber 110.

As FIG. 3 shows, nozzle 125 is seated between two adjacent flights of scroll conveyor 140. As described above, nozzles 125 are positioned between the flights to minimize impacting the flights with slurry discharge from nozzles 125. It may be desirable to maximize the size of nozzles 125, so that volumetric flow rate of slurry may be maximized while minimizing and/or reducing fluid velocity. In this manner, nozzles 125 may be sized to be as large as can fit between the flights. In other words, a limiting factor to an ideal size of nozzles 125 may be the distance between adjacent flights of scroll conveyor 140

Various embodiments of the present disclosure may include any quantity of nozzles 125 as may be appropriate. For example, one embodiment comprises twelve nozzles 125, roughly equally spaced around cylindrical section 120 of feed chamber 110. In other embodiments, other quantities of nozzles 125 are included.

According to various embodiments, decanter centrifuge 100 operates to separate a concentrated heavy phase from a clarified liquid in the separation zone and separately discharge the separated phases. Slurry to be separated by decanter centrifuge 100 enters feed chamber 110 via feed tube 115. The slurry is then forced out of the feed chamber 110, through one or more nozzles 125, into the separation zone 215 (depicted in FIG. 1) of the centrifuge bowl 210, where the separation may occur.

Referring back to FIG. 1, the heavy phase can be separated from the slurry by centrifugal acceleration moving solids up the frustoconical section 230 of centrifuge bowl 210 toward heavy phase discharge ports 160. The light phase is moved in the opposite direction, toward light phase discharge ports 165.

As the heavy and light phases are moved toward their respective discharge ports 160, 165, additional unseparated slurry continually enters the separation zone through nozzles 125. Separated phases may be conveyed away from discharge ports 160, 165 and out of the decanter centrifuge as the phases are discharged therefrom. In some embodiments, more than two phases are separated from each other. Each separated phase may have one or more discharge ports where it may be discharged.

Figure 4:
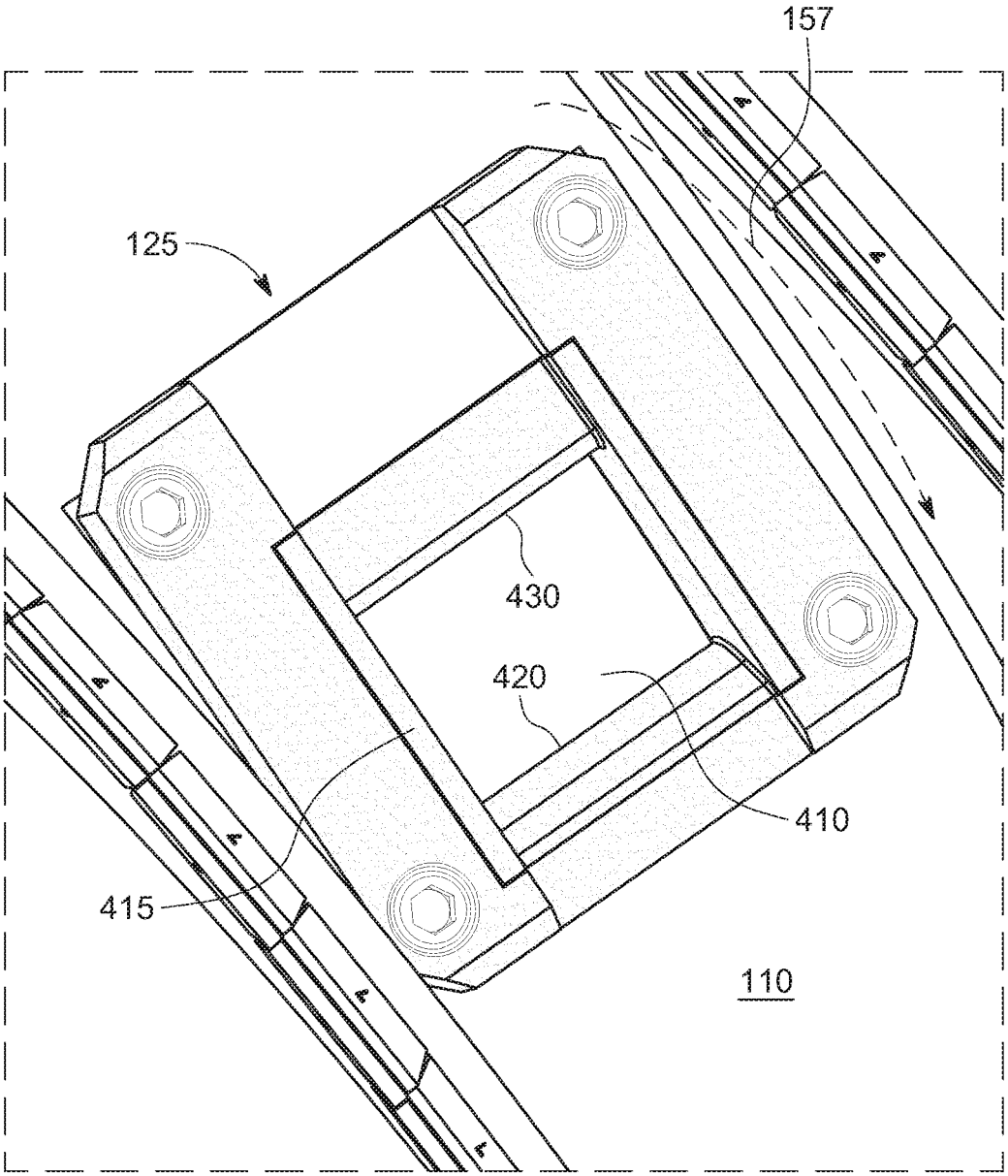
FIG. 4 is an exterior detail view of a decanter centrifuge nozzle shown in FIG. 2 and FIG. 3 according to one or more embodiments of the disclosure.

Referring now to FIG. 4, nozzle 125 is depicted from an outside view of feed chamber 110 according to one embodiment of the present disclosure. Nozzle 125 comprises aperture 410. In various embodiments, aperture 410 comprises a rectangular shape, which may maximize the size of the opening compared to a nozzle with a round aperture. Thus, a rectangular aperture 410 may provide increased flow rate through nozzle 125 for equivalent fluid velocity. In various embodiments, providing lower fluid velocity may result in a lower wear rate of the nozzle 125 as well as other surrounding components, such as the flights of scroll conveyor 140 and the inside walls of centrifuge bowl 210. Thus, nozzles 125 of the present disclosure may exhibit improved durability of various components within decanter centrifuge 100.

As depicted in FIG. 4, nozzle 125 comprises leading edge 420 and trailing edge 430, each defining opposing boundaries of aperture 410. Leading edge 420 and trailing edge 430 are delineated relative to, and in light of, rotational movement of feed chamber relative to centrifuge bowl 210

110 indicated by arrow 157. In the depiction of FIG. 4, rotation of feed chamber 110 involves downward movement of nozzle 125, in roughly the direction from trailing edge 430 to leading edge 420. In other words, leading edge 420 is forward of trailing edge 430 during rotational movement of feed chamber 110.

Figure 5:
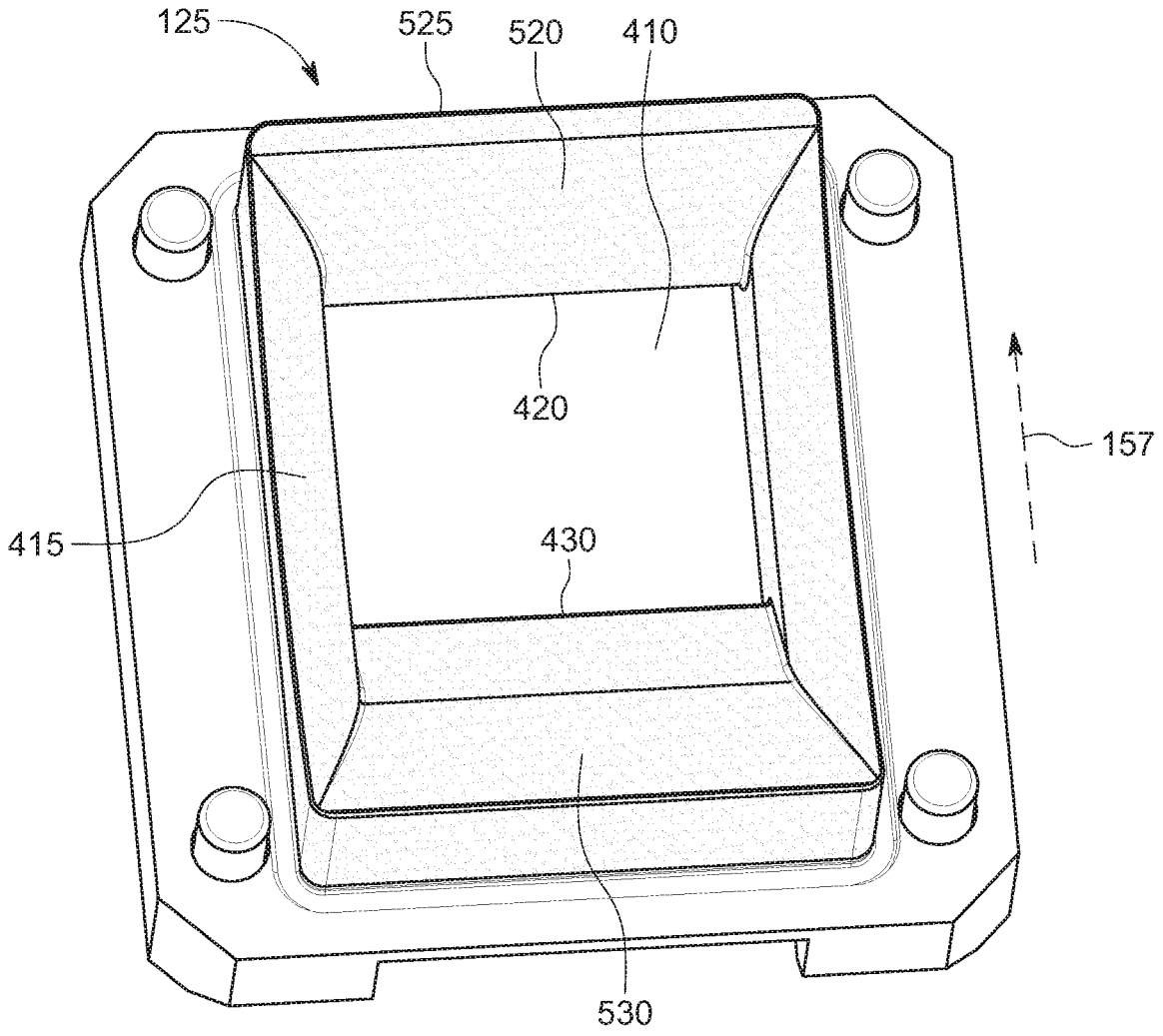
FIG. 5 is an interior detail view of a decanter centrifuge nozzle.

In embodiments of the present disclosure, leading edge 420 is rounded along the length of leading edge 420 with a curvature that extends from the outer surface of nozzle 125 depicted in FIG. 4 to the inner surface of nozzle 125 (depicted in FIG. 5).

In contrast, some embodiments of trailing edge 430 comprise an edge with an acute angle. Other embodiments comprise a curve having a relatively small radius. In various embodiments, trailing edge 430 has less curvature relative to leading edge 420. In one embodiment, the radius of curvature of trailing edge 430 is less than one-third of that of leading edge 420. In another embodiment, the radius of curvature of trailing edge 430 is less than one-fourth of that of leading edge 420. In another embodiment, the radius of curvature of trailing edge 430 is less than one-fifth of that of leading edge 420.

As shown in FIG. 5, interior surfaces of nozzle 125 may be seen according to an embodiment of the present disclosure. While nozzle 125 is mounted in feed chamber 110, FIG. 5 would be a view looking at nozzle 125 from within feed chamber 110 out into the annulus between feed chamber 110 and centrifuge bowl 210. As oriented in the depiction of FIG. 5, rotation of feed chamber 110 would involve upward movement of nozzle 125, in roughly the direction from trailing edge 430 to leading edge 420.

As set forth above and as depicted in FIGS. 4-5, nozzle 125 comprises a rectangular aperture 410 framed by aperture pad 415. According to various embodiments of the present disclosure, a perimetric edge of the interior-facing side of aperture pad 415 protrudes inwardly compared to adjacent interior surfaces of feed chamber 110, forming interior aperture pad perimetric leading edge 525 (also depicted in FIG. 6). As used herein. the term "perimetric" refers to a boundary, or portion of a boundary, along the perimeter of an object or element.

As feed chamber 110 rotates while filled with slurry, leading edge 525 may catch small amounts of sand, rocks, sediment, or other slurry particulate matter, thereby precipitating a small dam of such slurry matter. It is theorized that such a dam may result in lower wear rate of the nozzle 125, leading to longer service life.

It is also understood that nozzles 125 may exhibit a longer service life than prior art devices because nozzles 125 comprise a larger leading area, such as leading edge 525, where potentially damaging contact with slurry particles may be distributed. In comparison, prior art nozzles, some of which are round, may tend to result in particles being concentrated on relatively small leading areas, leading to faster wear and shorter service life.

In putting embodiments of the present disclosure into practice, it was found that nozzles 125 as disclosed herein may have approximately double the service life of some prior art nozzles. In particular, some prior art nozzles had a service life of approximately three to six months, whereas one nozzle according to embodiments of the present disclosure was tested for one year under similar conditions without failing.

It was found that embodiments according to the present disclosure may provide the benefit of less accumulation of slurry within feed chamber 110. This benefit may be the result of increased fluid flow rates through nozzles 125 out of feed chamber 110.

As shown in FIGS. 4 and 5, embodiments of the present disclosure include nozzles 125 assembled from multiple component parts. In one embodiment, aperture pad 415 comprises tungsten carbide material (indicated by darker surface pattern), while other components of the nozzle 125 assembly comprise a stainless steel material (indicated by lighter surface pattern). In other embodiments, various components of decanter centrifuge 100, including nozzles 125 and/or other components, are formed of other materials that may be suitable to applications of the decanter centrifuge. Selected materials may exhibit durability and/or low wear rate to withstand potentially damaging conditions caused by high volumes of slurry flow through decanter centrifuge 100.

In various embodiments of the present disclosure, a line from leading edge 420 to trailing edge 430 of each nozzle 125 would be approximately tangential to the outer annular walls of feed chamber 110, or approximately parallel to a line that is tangential to the outer annular walls of feed chamber 110. As used herein, the terms "tangential" and "tangentially" refer to imaginary lines that are defined as approximately tangential to the outer annular walls of feed chamber 110 at cylindrical section 120. The tangential direction may also be perpendicular to the axis of rotation of feed chamber 110.

As used herein, the terms "lateral" and "laterally" refer to imaginary curves that extend around the outer surfaces of the annular walls of cylindrical section 120 of feed chamber 110 and that are coplanar with tangential lines of cylindrical section 120 of feed chamber 110. As used herein, the terms "axial" and "axially" refer to imaginary lines that are approximately parallel to the axis of rotation of feed chamber 110. As used herein, the terms "longitudinal" and "longitudinally" refer to imaginary lines that extend along the length of the outer surfaces of the annular walls of cylindrical section 120 of feed chamber 110 and that are approximately parallel to axial lines.

As further shown in FIGS. 4 and 5, aperture pad 415 comprises two side members that frame aperture 410. In the embodiment depicted, the two side members are symmetrical to each other and on longitudinally opposed sides of nozzle 125. In other embodiments, the side members of nozzle 125 are not symmetrical to each other.

Figure 6:
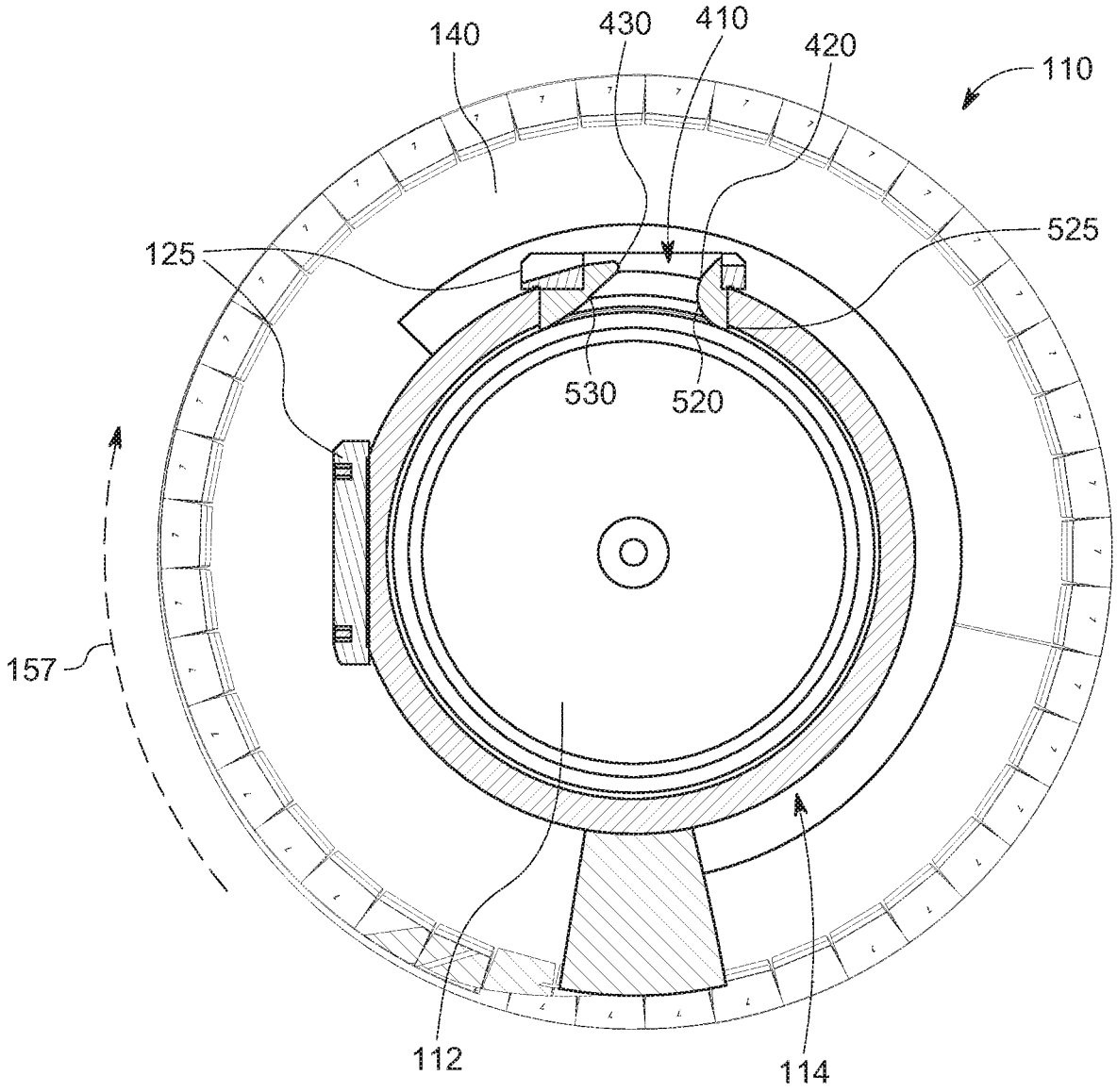
FIG. 6 is an axial section view of a feed chamber taken along line 6-6 in FIG. 2.

FIG. 6 depicts an axial section view of feed chamber 110 at cylindrical section 120 according to one embodiment. Leading edge 420 is adjacent to relatively steep incline on interior surface 520. Trailing edge 430 is adjacent to relatively shallow incline on interior surface 530. The respective inclines of surfaces 520, 530 are defined relative to an imaginary plane that is coplanar with aperture 410 and/or with tangential lines of cylindrical section 120 of feed chamber 110.

The shallow incline of surface 530, possibly in conjunction with other features of nozzle 125, may result in discharge flow from nozzle 125 that is more tangential than provided by prior art nozzles. It is understood that the relatively shallow incline of surface 530 may result in reduced shear of the slurry passing through nozzle 125 in comparison to prior art nozzles, which reduction may cause, at least in part, the slurry to flow in a more tangential direction as the slurry discharges from nozzles 125.

Figure 7:
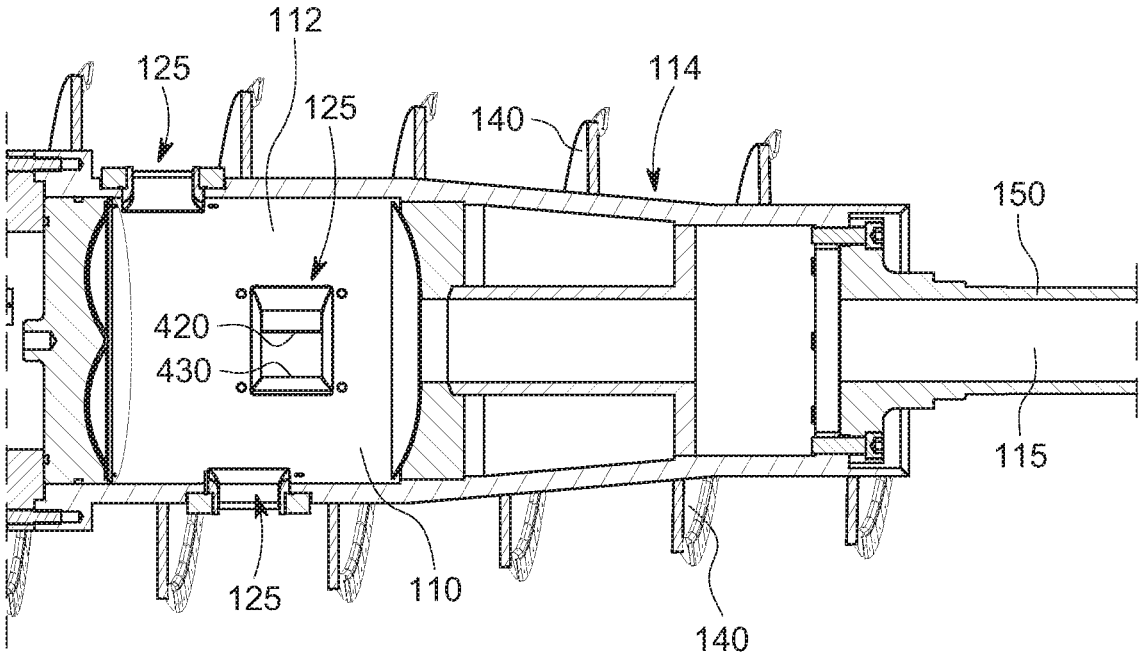
FIG. 7 is a lateral, sectioned, detail view of a feed chamber according to one or more examples of the disclosure.

FIG. 7 is a section detail showing interior surfaces of nozzle 125 within feed chamber 110 according to embodiments of the present disclosure. As described above, leading edge 420 and trailing edge 430 may interact with slurry passing through nozzle 125 in such a way to cause tangential, or near-tangential, flow of the slurry after it discharges through nozzle 125 into centrifuge bowl 210.

A computational fluid dynamic ("CFD") analysis was performed to simulate and analyze slurry discharge flow through nozzles 125 during operation of decanter centrifuge 100. In the CFD analysis, a flow pattern was developed in such way that slurry discharged from nozzles 125 in a direction approximately tangential, or near tangential, to the outer annular walls of feed chamber 110. According to various embodiments of the present disclosure, such tangential discharge may create a shorter spiral of slurry flow inside centrifuge bowl 210. A shorter spiral may be less likely to disturb wall cake on the interior surfaces of centrifuge bowl 210 and hence may maintain a more homogeneous and/or evenly distributed wall cake throughout centrifuge bowl 210. As a result, mass balance may be maintained in the rotating assembly, which can reduce vibration and improve wear rate.

Additionally, it is understood that the wall cake may act as a protective layer for interior surfaces of centrifuge bowl 210, thereby reducing wear of centrifuge bowl 210. A shorter spiral of slurry discharge within centrifuge bowl 210 may increase the velocity of the slurry inside centrifuge bowl 210, which can lead to better separation of solids and improved separation cut point.

Although the present disclosure is described in terms of certain preferred embodiments, other embodiments will be apparent to those of ordinary skill in the art, given the benefit of this disclosure, including embodiments that do not provide all of the benefits and features set forth herein, which are also within the scope of this disclosure. It is to be understood that other embodiments may be utilized, without departing from the spirit and scope of the present disclosure.

What is claimed is:

1. A decanter centrifuge comprising:
- a centrifuge bowl;
- a feed chamber within the centrifuge bowl, the feed chamber having an axis of rotation and a direction of rotation;
- a scroll conveyor coaxially aligned with the feed chamber, the scroll conveyor:
  - encircling the feed chamber;
  - comprising a plurality of conveyor flights;
  - being rotationally locked with the feed chamber; and
  - being in a separation zone of the centrifuge bowl;
- one or more nozzles providing fluid communication via a nozzle aperture from an interior volume of the feed chamber to the separation zone, each one of the one or more nozzles:
  - defining a rectangular aperture;
  - being located such that a discharge from the one nozzle discharges into a single space between two adjacent ones of the plurality of conveyor flights;
  - having a convex rounded leading edge defining a first boundary of the aperture; and
  - having a trailing edge defining a second boundary of the aperture,
    - the leading edge and the trailing edge being delineated in that the direction of rotation of the feed chamber coincides with a direction from the trailing edge to the leading edge; and
    - the interior of the feed chamber being cylindrical except for the leading and trailing edges of the rectangular apertures of the nozzles.

2. The decanter centrifuge of claim 1, each one of the one or more nozzles comprising an inner leading edge surface and an inner trailing edge surface, the inner leading edge surface and the inner trailing edge surface extending from the leading edge and trailing edge, respectively, inside the feed chamber.

3. The decanter centrifuge of claim 2, wherein the inner leading edge surface has a steeper incline than the inner trailing edge surface, the inclines being relative to an imaginary plane that is coplanar with tangential lines of exterior surfaces of the feed chamber.

4. The decanter centrifuge of claim 1, wherein the nozzle aperture is framed by an aperture pad comprising a perimetric leading edge protruding inside the feed chamber.

5. The decanter centrifuge of claim 4, wherein the aperture pad comprises tungsten carbide.

6. The decanter centrifuge of claim 1, wherein the trailing edge comprises an acutely angled edge.

7. The decanter centrifuge of claim 1, wherein the trailing edge comprises a rounded edge having a radius of curvature that is less than one-fourth of a radius of curvature of the leading edge.

8. A decanter centrifuge nozzle comprising:
- a rectangular aperture;
- a convex rounded leading edge of the aperture; and
- a trailing edge facing the rounded leading edge across an interior of the aperture,
- the leading edge to precede the trailing edge when the nozzle is in motion during centrifuge operation;
- the nozzle to be mounted in a feed chamber that is cylindrical except at the leading and trailing edges of the aperture; and
- the aperture to be positioned between conveyor flights such that slurry does not impact the conveyor flights as it passes through the aperture during centrifuge operation.

9. The decanter centrifuge nozzle of claim 8, further comprising an inner leading edge surface and an inner trailing edge surface, the inner leading edge surface and the inner trailing edge surface extending from the leading edge and trailing edge, respectively, on an interior side of the nozzle.

10. The decanter centrifuge nozzle of claim 9, wherein the inner leading edge surface has a steeper incline than the inner trailing edge surface, the inclines being relative to an imaginary plane that is coplanar with the aperture.

11. The decanter centrifuge nozzle of claim 8, wherein the rectangular aperture is framed by an interior aperture pad comprising a perimetric leading edge.

12. The decanter centrifuge nozzle of claim 11, wherein the leading edge and the aperture pad comprise tungsten carbide.

13. The decanter centrifuge nozzle of claim 8, wherein the trailing edge comprises an acutely angled edge.

14. The decanter centrifuge nozzle of claim 8, wherein the trailing edge comprises a rounded edge having a radius of curvature that is less than one-fourth of a radius of curvature of the leading edge.

15. A method of separating two phases of a slurry, the method comprising:
- charging the slurry into a feed chamber within a centrifuge bowl of a decanter centrifuge, the feed chamber being coaxially aligned with a scroll conveyor and with the centrifuge bowl, the scroll conveyor:
  - encircling the feed chamber;
  - comprising a plurality of conveyor flights; and
  - being in a separation zone of the centrifuge bowl;

discharging the slurry from the feed chamber into the separation zone of the centrifuge bowl via one or more nozzles, each one of the one or more nozzles:

comprising a rectangular aperture;

being located such that a discharge from the one nozzle discharges into a single space between two adjacent ones of the plurality of conveyor flights;

having a convex rounded leading edge defining a first boundary of the aperture; and having a trailing edge defining a second boundary of the aperture, the leading edge and the trailing edge being delineated in that a direction of rotation of the feed chamber coincides with a direction from the trailing edge to the leading edge;

the interior of the feed chamber being cylindrical except for the leading and trailing edges of the rectangular apertures of the nozzles, rotating the feed chamber in the direction of rotation, thereby imparting centrifugal acceleration upon the slurry, separating the slurry into the two phases; and discharging the two separated phases from the decanter centrifuge.

16. The method of claim 15, in which the scroll conveyor is rotationally locked with the feed chamber.

17. The method of claim 15, in which each one of the one or more nozzles comprise an inner leading edge surface and an inner trailing edge surface, the inner leading edge surface and the inner trailing edge surface extending from the leading edge and trailing edge, respectively, inside the feed chamber.

18. The method of claim 17, in which the inner leading edge surface has a steeper incline than the inner trailing edge surface, the inclines being relative to an imaginary plane that is coplanar with tangential lines of exterior surfaces of the feed chamber.

19. The method of claim 15, in which the nozzle aperture is framed by an aperture pad comprising a perimetric leading edge protruding inside the feed chamber.

20. The method of claim 15, in which the trailing edge comprises a rounded edge having a radius of curvature that is less than one-fourth of a radius of curvature of the leading edge.

* * * * *